US005798781A

United States Patent [19]

Pedersen et al.

[11] Patent Number: 5,798,781

[45] Date of Patent: Aug. 25, 1998

[54] PRINTER

[76] Inventors: Niels B. Pedersen, 2131 St. Clair St., Racine, Wis. 53402; Steen B. Mikkelsen, 2200 S. Britton Rd., Kansasville, Wis. 53139; Eva M. Wallström, EnPro Aps Lerso Parkalle 42, DK-2100 Copenhagen, Denmark

[21] Appl. No.: 433,541

[22] Filed: May 2, 1995

[51] Int. Cl.[6] ..... B41J 2/18

[52] U.S. Cl. ..... 347/89; 347/100

[58] Field of Search ..... 347/89, 100

[56] References Cited

U.S. PATENT DOCUMENTS 4,970,533 11/1990 Takashi et al. ..... 347/87

5,159,348 10/1992 Dietl et al. ..... 347/100

5,231,424 7/1993 Kaneko et al. ..... 347/89

5,310,778 5/1994 Shor et al. ..... 347/100

*Primary Examiner*—Valerie Lund

*Attorney, Agent, or Firm*—Joseph T. Kivlin, Jr.

[57] ABSTRACT

A continuous ink refill system for ink-jet printers, of the kind employing a disposable ink cartridge, wherein an aqueous suspension of a pigmented ink is continually circulated through the cartridge by means of a pressure pump, with unused ink being returned from the cartridge to an ink reservoir.

4 Claims, 2 Drawing Sheets

PRINTER

BACKGROUND

The present invention relates to ink-jet printers. More specifically it relates to ink-jet printing system which are especially suitable for the use with pigmented inks.

The Erickson patent, U.S. Pat. No. 5,369,429, issued Nov. 29, 1994, discloses the use of an ink containing disposable cartridge mounted on a reciprocating printing head. Such cartridges are well known, having been provided for many years by the Hewlett-Packard Company of Palo Alto, Calif., which is also well known for its line of ink-jet printers. U.S. Pat. No. 4,500,895, assigned to Hewlett-Packard, discloses in detail the operation of such cartridges and is incorporated herein by reference. For the most part the prior art has employed such disposable cartridges in its ink-jet printers, with cartridges requiring replacement each time the supply of ink is exhausted.

The Erickson patent, referred to above, contemplates the use of a reservoir for the ink and provides a means for it to be transported from such reservoir to the printing head in a system having a reduced pressure. The inks contemplated by Erickson are transported by flexible tubing to the cartridge and printing head, but the ink in the head is not recirculated to the reservoir.

The present invention, on the other hand, relates to an improvement over the Erickson system and over the many references cited in that patent, all of which have been found to be unsatisfactory for pigmented inks, which have a tendency to precipitate within the cartridge and thereby dog the orifices of the jet. By providing an oscillating or non-continuous pump, and by providing the cartridge with return tubing, the ink not employed in each pass of the printhead is returned to the reservoir and the pigment remains suspended in the liquid medium. The pump keeps the liquid and suspended pigment moving throughout the entire circuit. Moreover, it is believed that the "shock wave" created by each stroke of the pump may also help to keep the pigment in suspension. Obviously multiple colors will require a corresponding number of pumps and return tubing, one for each color.

The present invention is particularly desirable for use in printing on substrates having large dimensions, such as those intended for use in outdoor advertising, where the printed work is subjected to ultraviolet rays, as well as the extremes of weather. Indoor signs may also benefit from the use of the present invention, since the pigmented inks do not as readily fade when subjected to UV as do non-pigmented inks.

SUMMARY OF THE INVENTION

The present invention has for its object a system for transporting ink from its reservoir to a printing cartridge and printing head, and returning the ink to the reservoir to the extent it has not been consumed during each pass of the printing head over the substrate to be printed.

It is also an object of the present invention to reduce or eliminate the incidence of clogging of ink-jets due to the presence of pigments in the inks employed; to eliminate the problem of bubbles in the system; and to make it possible to refill the ink reservoir while the system is in operation.

It is an object of the present invention to facilitate the use of cartridges for much longer periods before they require changing, as much as eight or ten times as long, and to make it easier to change them when that is required.

It is an object of the present invention provide an ink-jet printing system which can be started without priming, i.e. it can be started even when the cartridge is empty.

Finally, it is an object of the present invention to facilitate the use of heavy materials such as vinyl sheeting of large dimensions upon which the printing indicia is to appear.

DETAILED DESCRIPTION

Figure 1:
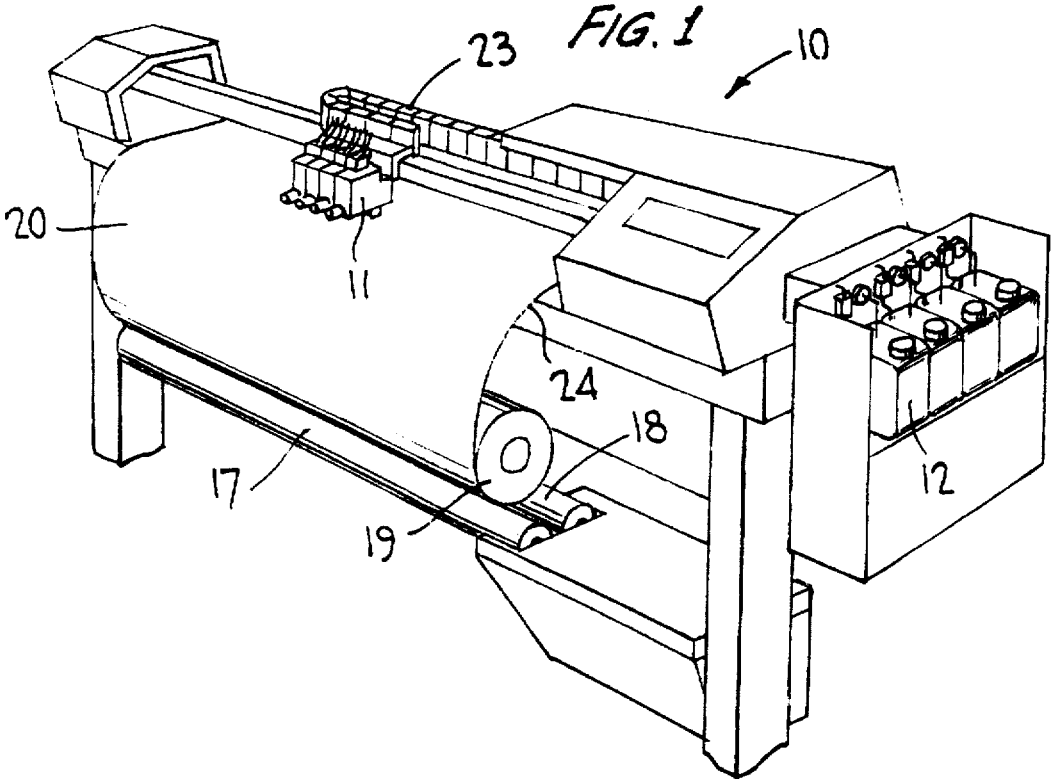
FIG. 1. is a prospective view of an inkjet printer utilizing the present invention.
Figure 3:
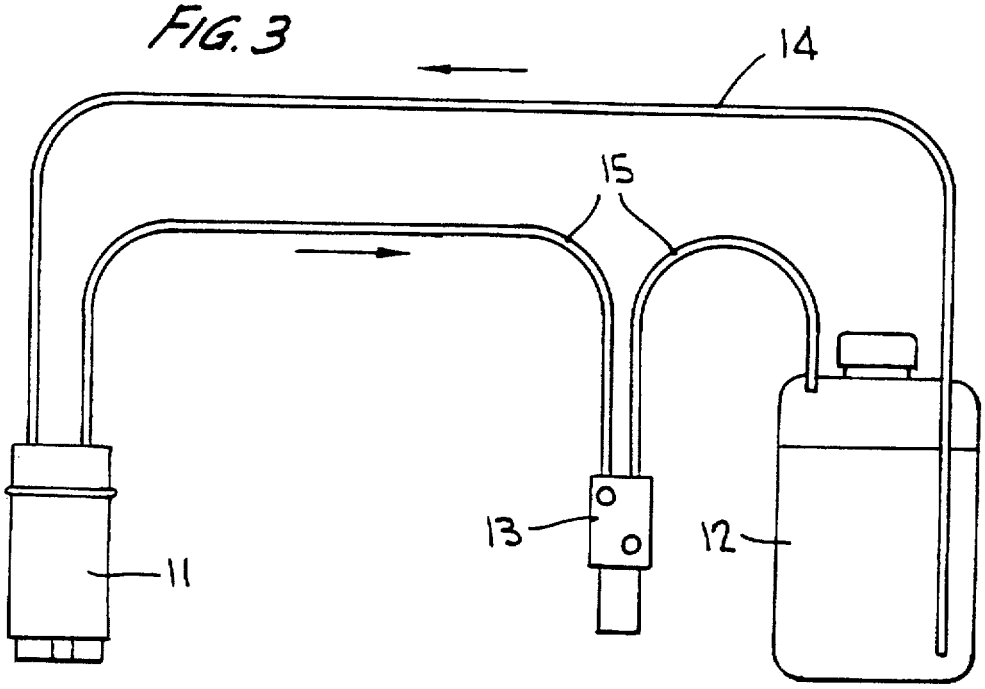
FIG. 3. is a plan view of the inking system, showing one cartridge and one reservoir with a pressure pump disposed therebetween.

FIG. 1 of the drawings shows an ink-jet printer employing the present invention. This appears generally at 10. The printer uses at least one ink cartridge 11, and an ink reservoir 12, which is equipped with an oscillating pump 13, and a pair of tubes to carry ink from the reservoir to the printing head and to return the ink from the cartridge to the reservoir. This is most clearly seen in FIG. 3, where arrows show the direction of flow of the ink, with tubing 14 carrying the ink from the reservoir to cartridge 11, and with return tubing 15 to carry the unused ink through pump 13 from cartridge to reservoir 12.

Returning to FIG. 1, the work piece 20 is a film which is mounted on a supply roll 19 which in turn is carried by a pair of rollers 17 and 18, one of which may be motor driven if desired. As is well known in the art, the work piece, in this case designated as 20, is forced to travel over the platen 24 by means of a small powered roller, which is not shown. During such travel, it is impressed with the indicia from the ink cartridges 11. As is well known, the ink cartridge 11 is propelled back and forth in a reciprocating action across the entire width of work piece 20 while ink is dispensed from said cartridges. The ink supplied to such cartridges by reservoir 12. is in tubing which is carried by a chain link housing 23. Housing 23 serves to prevent tubing 14 and 15 from becoming snarled or from disturbing the quality of the indicia being printed. In a preferred embodiment, tubing 14 and 15 is preferably Teflon tubing having an outside diameter of 0.062 inches.

Figure 2:
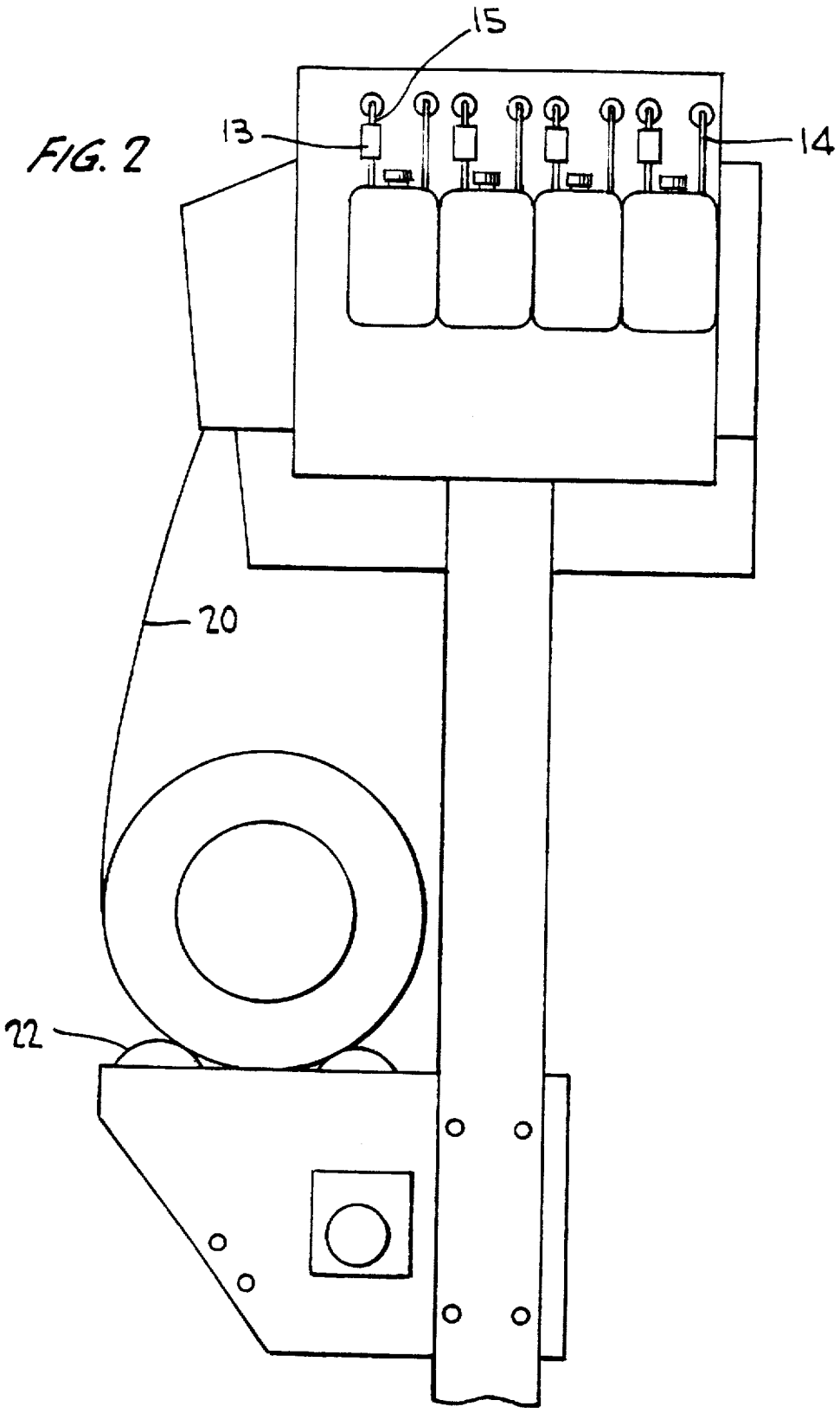
FIG. 2. is an enlarged elevation of one embodiment of such ink-jet printer, showing reservoirs for four different inks and showing the work substrate carried on a supply roll mounted below said reservoirs.

FIG. 2 shows, in somewhat more detail, the structure and disposition of the reservoir element 12 and the disposition of the printing work piece 20. If the substrate is a vinyl film, which is relatively heavy per square inch, then it may be necessary to provide power to one of the rollers 17 or 18 supporting the vinyl supply roll. By driving the supply roll, less energy is necessary for the printer to move the vinyl forward over platen 24 after each pass of the printing head. For an great length of work, a take-up roll, not shown, can also be provided on the discharge side of platen 24.

Pressure pump 13. is a one-way oscillating pump manufactured by the Lee Company of Westbrook Conn. In a preferred embodiment, it has a capacity of fifty (50 ml) microliters per stroke, and is designated by the manufacturer as "LPVA", Model No. 1220050L. The pump obviously must be supplied with electric power at the appropriate voltage. Such details and other specifications are provided in the 6th edition of a handbook published by the Technical Center of The Lee Company in 1994 and are incorporated herein by reference.

The result of this combination of elements is that ink in cartridge 11 is recirculated to the reservoir to the extent that it is not consumed in each pass of the print head or cartridge 11. When the printer of the present invention is employed, the orifice of each printing element does not become clogged during the course of any printing operation. Occasionally, upon restarting the printer, especially after a long downtime, it may be necessary to do some cleaning. In such case, an ultra-sonic vibrator can be employed, by attaching a piezo electric element to one of the components, with no other manual contact with the printing element being necessary. It has also been found that the clogging problem is minimized by the use of certain additives to the ink formulation. For example, certain anti-foaming agents have been found to have the side effect of reducing clogging as well as suppressing the formation of air bubbles in the system.

The cartridge preferred according to the present invention is that being present supplied by the Hewlett-Packard company. It has been found that by practicing the present invention, such cartridges require replacement much less frequently, despite the use of pigmented ink compositions. Replacements may require emptying, since they are normally supplied with a non-pigmented ink, and they require minor modification to provide attachment means for supply tubing 14 and return tubing 15.

Reservoir 12 is ideally provided with a closure which can be manually removed. Because of the nature of the present invention, such closure can be removed and reservoir 12 readily refilled even simultaneously during a printing operation.

It should be noted that the inks preferably employed in the present system are in themselves believed to be unknown in the prior art. They consist of pigments which are suspended in an aqueous medium. In general such compositions, according to the present invention, comprise about 50 to 95% water, ideally 70 to 82% by weight, pigment in the amount ranging from about 1 to 10%, but preferably from 3 to 8% by weight, and a co-solvent in an amount in the range of about 5 to 35%, but preferably 15 to 25% by weight. In addition, such compositions may employ minor amounts of other additives in amounts ranging from about 0.5 to 10%, but preferably 1 to 5% by weight. In addition to anti-foaming agents such additives can include surfactants, biocides, humectants, UV absorbers and agents to regulate the pH of the medium. Preferably, the co-solvent is a glycol, a glycol ester, or glycol ether.

Suitable pigments among many which can be employed, according to this invention, include a yellow pigment having a color index number of 13 or 83; for magenta, a red pigment having a color index number of 184; for cyan, a blue pigment, having a color index number of 15.3; and a black pigment, having a color index number of 7. Such pigments should first be dispersed in a glycol such as 1,2 propylene glycol, diethylene glycol, or glycerol. The dispersion should contain 40% by weight of the pigment, but can range between 30 up to 55% by weight; 5% by weight glycol, which could range from 0 to 20% by weight; and the balance to 100% by weight of water, prefereably distilled or deionized.

The pigment dispersion is admixed with glocol, water and amine to prepare inks of the following compositions>

| | Weight Percent | |
|---|---|---|
| EXAMPLES 1 & 2 | Yellow | Magenta |
| Pigment dispension | 16 | 15 |
| 1,2 Propylene glycol | 16 | 15 |
| Deionized watee | 67.8 | 69.2 |
| Aminomethyl propanol | 0.2 | 0.2 |
| EXAMPLES 3 & 4 | Cyan | Black |
| Pigment dispension | 10 | 16 |
| Diethylene glycol | 15 | 16 |
| Deionized water | 74.8 | 67.8 |
| Amino methyl propanol | 0.2 | 0.2 |

In the foregoing examples, the pH should be ajusted to 7–8, and the viscosity should be in the range of 18–25 s at 22° C., as measured with Shell cup #1. Control of viscosity is necessary to accomodate the particular ink jet being used on the printer. Surface tension is another factor which requires control, depending on the nature of the work to be printed upon. A surfactant can by employed to regulate this quality. As indicated, an anti-foam agent can be employed, and the rate of evaporation can also be controlled by the addition of 1 to 5 percent by weight of the total composition of a humectant such as glycerol or polyethylene glycol.

The disclosure of this invention is intended to be illustrative only. It is not intended to be exhaustive in describing the present invention, and it will be obvious that many changes and refinements can be made within the spirit of the present invention by employing elements other than those recited herein as preferred. For example, one might employ a different cartridge or a different pump other that those preferred herein. Similarly, specific ink formulations can be used without departing from the scope of the present invention.

What is claimed is as follows:

1. An ink-jet printing system consisting of:

(a) a reciprocating print carriage which moves in a generally horizontal plane over a print receiving medium;

(b) a disposable ink-jet cartridge removably mountable in said print carriage, said cartridge containing a print head and an ink supply container;

(c) an ink reservoir, external of said print carriage, for supplying liquid ink continuously to said cartridge;

(d) tubing for continuously transporting said ink from said reservoir to said cartridge and to return unused ink from said cartridge to said reservoir, said tubing being enclosed in a flexible housing;

(e) a pump for continuously forcing said ink to circulate from said reservoir to said cartridge and to return it to said reservoir during the entire operation of said system; and (f) an ink consisting of an aqueous dispersion of pigment.

2. The ink jet printing system of claim 1, wherein said dispersion consists of about 70 to 82% by weight water, a co-solvent in the amount of about 15 to 25% by weight, and about 3 to 8% by weight of a colorant selected from the group consisting of a pigment, a particle coated with dye, and a dye droplet having an insoluble coating.

3. The ink jet printing refill system of claim 2, having an anti-foaming agent in an amount sufficient to prevent clogging of said print head.

4. A method of printing consisting of applying to a substrate an ink composition consisting of about 70 to 82% by weight water, a co-solvent in the amount of about 15 to 25% by weight, and about 3 to 8% by weight of a colorant selected from the group consisting of a pigment, a particle coated with dye, and a dye droplet having an insoluble coating, said ink composition being applied by a printing apparatus consisting of:

(a) a reciprocating print carriage which moves in a generally horizontal plane over a print receiving medium, the improvement which comprises (b) a disposable ink-jet cartridge removably mountable in said print carriage, said cartridge containing a print head and an ink supply container;

(c) an ink reservoir, external of said print carriage, for supplying liquid ink continuously to said cartridge;

(d) tubing for continuously transporting said ink from said external ink reservoir to said cartridge and to return unused ink from said cartridge to said reservoir, said tubing being enclosed in a flexible housing; and (e) a pump for continuously forcing said ink to circulated from the reservoir to the cartridge and to return it to the reservoir during application of said ink composition.

* * * * *